US005197604A

United States Patent [19]

Jedlitschka et al.

[11] Patent Number: 5,197,604

[45] Date of Patent: Mar. 30, 1993

[54] HIGH-VOLTAGE CHANGE-OVER SWITCH WITH LINEAR MOVEMENT

[75] Inventors: Hans Jedlitschka, Chatillon; Jacques Sireul, Wissous, both of France

[73] Assignee: General Electric CGR S.A., Issy les Moulineaux, France

[21] Appl. No.: 832,466

[22] Filed: Feb. 7, 1992

[30] Foreign Application Priority Data

Feb. 8, 1991 [FR] France ..... 91 01441

[51] Int. Cl.[5] ..... H01H 15/06

[52] U.S. Cl. ..... 200/572; 200/149 R; 200/149 B

[58] Field of Search ..... 200/572, 568, 561, 10, 200/48 P, 244, 144 A, 144 R, DIG. 9, 149 R, 149 B; 74/480 R, 483 R; 337/68, 91

[56] References Cited

U.S. PATENT DOCUMENTS

| | | | |
|---|---|---|---|
| 1,833,173 | 11/1931 | Murray et al. | 337/10 |
| 4,157,524 | 6/1979 | Lamarche | 337/68 |
| 4,755,754 | 7/1988 | Sireul et al. | 324/216 |
| 4,923,295 | 5/1990 | Sireul et al. | 359/881 |
| 4,944,501 | 7/1990 | Sireul et al. | 5/601 |
| 5,003,452 | 3/1991 | Sireul et al. | 363/61 |
| 5,060,253 | 10/1991 | Jedlitschka et al. | 378/101 |

FOREIGN PATENT DOCUMENTS

| | | | |
|---|---|---|---|
| 2829860 | 1/1980 | Fed. Rep. of Germany . | |
| 3041634 | 6/1982 | Fed. Rep. of Germany . | |
| 3802623 | 8/1989 | Fed. Rep. of Germany . | |
| 424512 | 8/1947 | Italy | 200/144 |

*Primary Examiner*—Henry J. Recla
*Assistant Examiner*—David J. Walczak
*Attorney, Agent, or Firm*—Pollock, VandeSande & Priddy

[57] ABSTRACT

A change-over switch comprises four input terminals connected in pairs to one of the two poles +HT and −HT of a high voltage generator and four output terminals connected in pairs to one of two X-ray tubes. It includes two identical half change-over switches with coupled control, each half change-over switch comprising two contact devices, each constituted by a fixed contact element and a movable contact element between which there is interposed an insulation device when the electrical contact is open. The movable contact elements and the insulation device of each half change-over switch are connected to one another to have combined movements.

15 Claims, 5 Drawing Sheets

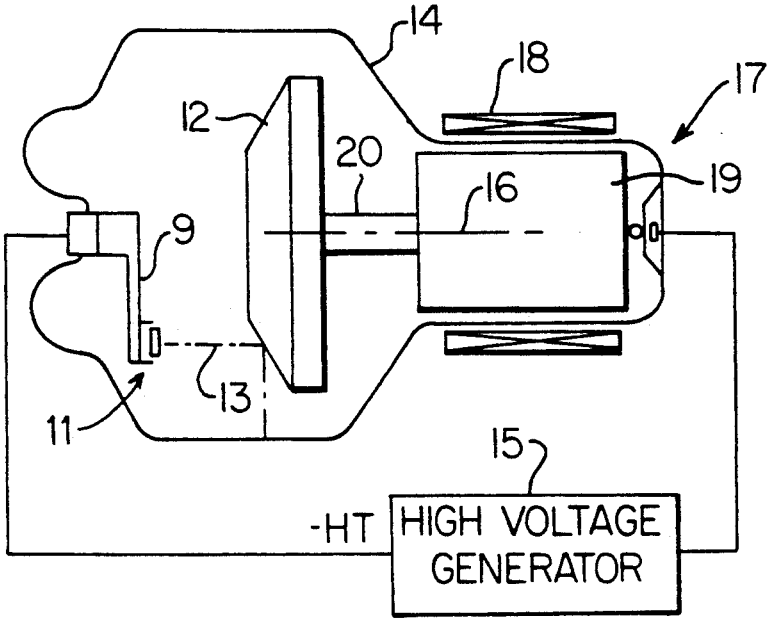
FIG. 1
FIG. 2
PRIOR ART
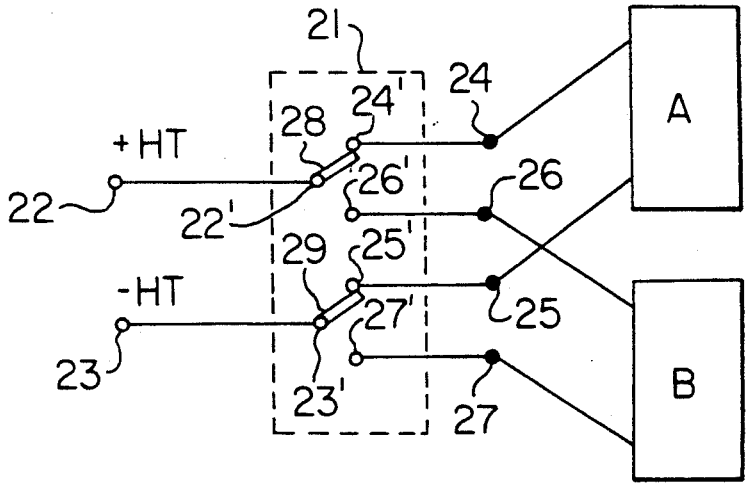
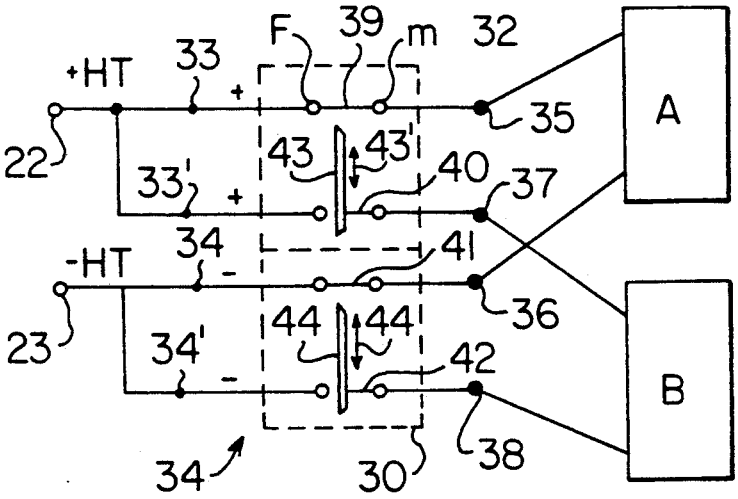
FIG. 3

HIGH-VOLTAGE CHANGE-OVER SWITCH WITH LINEAR MOVEMENT

BACKGROUND OF THE INVENTION

1. Field of the Invention

The invention relates to high-voltage change-over switches and, more particularly, to those used to provide supplies alternately to at least two X-ray tubes from a single high-voltage generator.

X-ray tubes for medical diagnosis are generally constituted (FIG. 1) like a diode, i.e. with a cathode 11 and an anode 12 or anti-cathode, these two electrodes being enclosed in a vacuum-tight casing 14 that provides for the electrical insulation between these two electrodes. The cathode 11 produces a beam 13 of electrons and the anode receives these electrons on a small area that constitutes a focal spot from which the X-rays are emitted.

When the high supply voltage is applied by a generator 15 to the terminals of the cathode 11 and of the anode 12 so that the cathode is at a negative potential −HT and the anode at a positive potential +HT, a current known as an anode current flows in the circuit through the generator 15 supplying the high voltage. The anode current goes through the space between the cathode and the anode in the form of the beam 13 of electrons which impinge on the focal spot.

A small proportion of the energy used to produce the electron beam 13 is converted into X-rays, the rest of this energy being converted into heat. Hence, in view also of the high instantaneous power (in the range of 100 KW) brought into play and of the dimensions of the focal spot (in the range of one millimetre), manufacturers have long been making X-ray tubes with rotating anodes where the anode is made to rotate in order to distribute the heat flux on a ring called a focal ring, with an area far greater than that of the focal spot, the value of this approach increasing concomitantly with the rise in rotational speed (generally between 3,000 and 12,000 rpm).

The standard type of rotating anode has the general shape of a disk with an axis of symmetry 16 about which it is made to rotate by means of an electrical motor 17; the electrical motor has a stator 18 located outside the casing 14 and a rotor 19 mounted in the casing 14 of the X-ray tube and positioned along the axis of symmetry 16, the rotor being mechanically fixed to the anode by means of a supporting shaft 20.

2. Description of the Prior Art

The high-voltage generator 15, which gives a voltage ranging from 50 to 160 kilovolts between the −HT and +HT terminals, is a major, bulky and costly element of a radiological apparatus. Thus, in radiology installations comprising several X-ray tubes, there is provision for using only one high-voltage connector which is connected to the different X-ray tubes by means of a high-voltage change-over switch, the schematic diagram of which is given in FIG. 2 which depicts the case of a change-over switch 21 for the supply of two tubes A and B. This change-over switch 21 has two input terminals 22 and 23, respectively connected to the +HT and −HT terminals of the high-voltage generators, and two pairs of output terminals 24, 25 and 26, 27 respectively connected to the tubes A and B. The switching over is done by means of two rotary arms 28 and 29 connected on one side (contact elements 22' and 23') respectively to the input terminals 22 and 23 and, on the other side, either to the output terminals 24 and 25 (contact elements 24' and 25') for a first position of the arms (when supplying the tube A) or to the output terminals 26 and 27 (contact elements 26' and 27') for a second position of the arms (when supplying the tube B). With a mechanism such as this, it is necessary for the distances between the different contact elements to be great enough to prevent conduction by electrical arcing. Thus, in dry air, the distances should be of the order of several centimetres, for example 15 centimetres for 150 kilovolts, which results in change-over switches that are large-sized and hence very bulky. Thus, to reduce this bulk, it is usual to place the change-over switch or switches in a chamber filled with insulating oil, the disruptive voltage of which is equal to or greater than 10 kilovolts per millimetre instead of one kilovolt per millimetre in dry air. This leads, naturally, to greater compactness but entails the necessity of using an oil-filled chamber.

SUMMARY OF THE INVENTION

The object of the invention, therefore, is to make a compact high-voltage change-over switch, with or without the use of insulating oil, in implementing a potential barrier made of a material with high dielectric strength, such as a polypropylene or polyethylene type polymer, the disruptive voltage of which is equal to or greater than 80 kilovolts per millimetre.

The invention relates to a high-voltage change-over switch with linear movement for the alternate application of a high voltage either to a first X-ray tube or to a second X-ray tube, said device comprising two identical half change-over switches, each half change-over switch comprising two input terminals and two output terminals, and each input terminal being connected to only one output terminal by means of a contact device that comprises a fixed contact element and a movable contact element shifting in a linear movement so as to come into contact with said fixed contact element or to move away from it, said linear movement of the two movable contact elements of a half change-over switch being obtained by the linear shifting of an insulation device in a direction perpendicular to the movement of the movable contact elements, said insulation device working together with the two movable contact elements in such a way that, in a first position of the insulation device, a first contact device is open while the second one is closed and that, in a second position of the insulation device, the first contact device is closed while the second one is open, the contact elements facing each open contact device being separated by a strip made of insulating material that constitutes the insulation device.

DESCRIPTION OF THE DRAWINGS

Other objects, features and advantages of the present invention shall appear from the following description of a particular exemplary embodiment, said description being made in relation to the appended drawings, of which:

FIG. 1 is a schematic diagram of an X-ray tube with rotating anode supplied by a high-voltage generator;

FIG. 2 is a schematic diagram of a high-voltage change-over switch of the type with rotary arms according to the prior art;

FIG. 3 is a schematic diagram of a high-voltage change-over switch according to the present invention;

MORE DETAILED DESCRIPTION

Figure 4A:
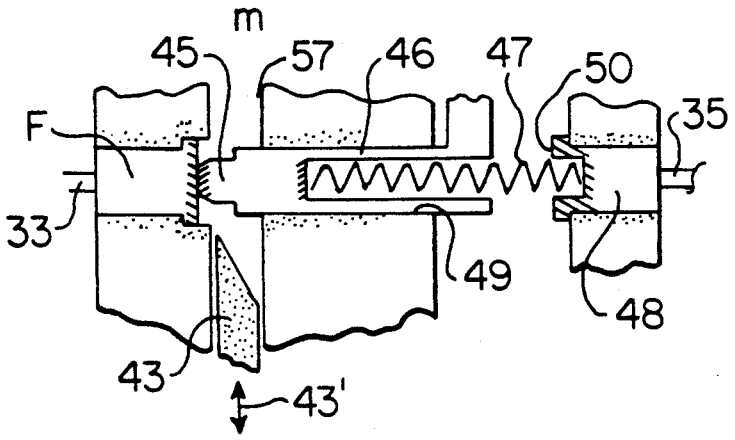
FIGS. 4-*a* and 4-*b* are sectional views of one of the contact devices of the change-over switch according to the invention, showing the "closed" or "open" positions of the contact.
Figure 4B:
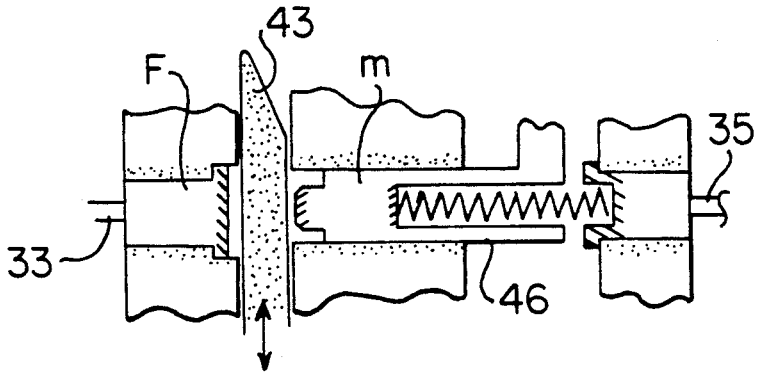
Figure 5A:
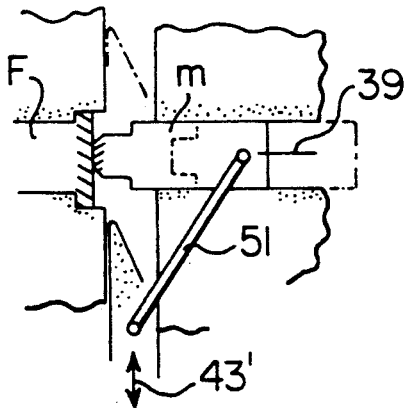
FIG. 5-*a* and 5-*b* are sectional views of one of the contact devices of the change-over switch according to the invention showing two devices to control the movement of the contact.
Figure 5B:
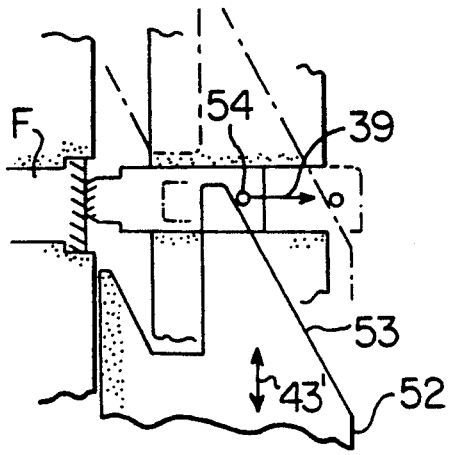

In accordance with FIG. 3, the change-over switch 31 according to the invention is designed to apply a high voltage taken, for example, between the +HT and −HT terminals of a generator 15 (FIG. 1), either to a tube A or to a tube B. It comprises two half change-over switches 32 and 30 each respectively comprising two input terminals 33, 33' and 34, 34' and two output terminals 35, 37 and 36, 38. The input terminals 33 and 33' are, for example, connected to the +HT output terminal of the generator 15 while the input terminals 34 and 34' are connected to the −HT output terminal of the same generator. With such connections to the input terminals, the connections to the output terminals are such that the terminals 35 and 36 are connected to the tube A while the terminals 37 and 38 are connected to the tube B. Each half change-over switch 32 or 30 is constituted by two contact devices each comprising (FIGS. 3, 4 and 5) a fixed contact element connected, for example to an input terminal and a movable contact element m, connected to an output terminal, which shifts linearly in the direction indicated by the arrow 39 (or 40, 41, 42) and a movable insulation device 43 (or 44) made of a polymer with high dielectric strength that shifts linearly along the double-headed arrow 43' (44') in such a way as to get interposed (FIG. 4-*b*) or not interposed (FIG. 4-*a*) between the contact elements m or f of a contact device. The linear movement of the contact device is perpendicular to that of the movable contact elements and these two linear movements are combined with each other by means of link-rod type mechanisms (FIG. 5-*a*) or ramp type mechanisms (FIG. 5-*b*).

The combination of the movements is such that at no time during the insertion of the insulation device between the contacts m and f does this device touch the contacts. This is in order to prevent any pollution due to friction.

More precisely, the movable contact element m of each contact device is formed by four parts 45, 46, 47 and 48:

a hollow finger 46, made of an insulator material for example, that slides in a bore 49 of a support that shall be described hereinafter;

a first metal element 45 borne by the end of the hollow finger 46 which is designed to come into contact with the fixed contact element f, a second metal element 48 that is fixed and is connected to an output terminal, and a metal spring 47 made of conductive metal, one end of which leans on the first metal element 45 within the hollow finger 46 and the other end of which leans on the second metal element 48 on a blind hole of this element 48.

The hollow finger 46 is hinged with the insulation device 43 (or 44) either by means of a lever 51 (FIG. 5-*a*) or by means of an element 52 (FIG. 5-*b*) that is fixedly joined to the insulation device 43 and has a ramp 53 that cooperates with a pin 54 fixedly joined to the hollow finger 46.

Figure 6:
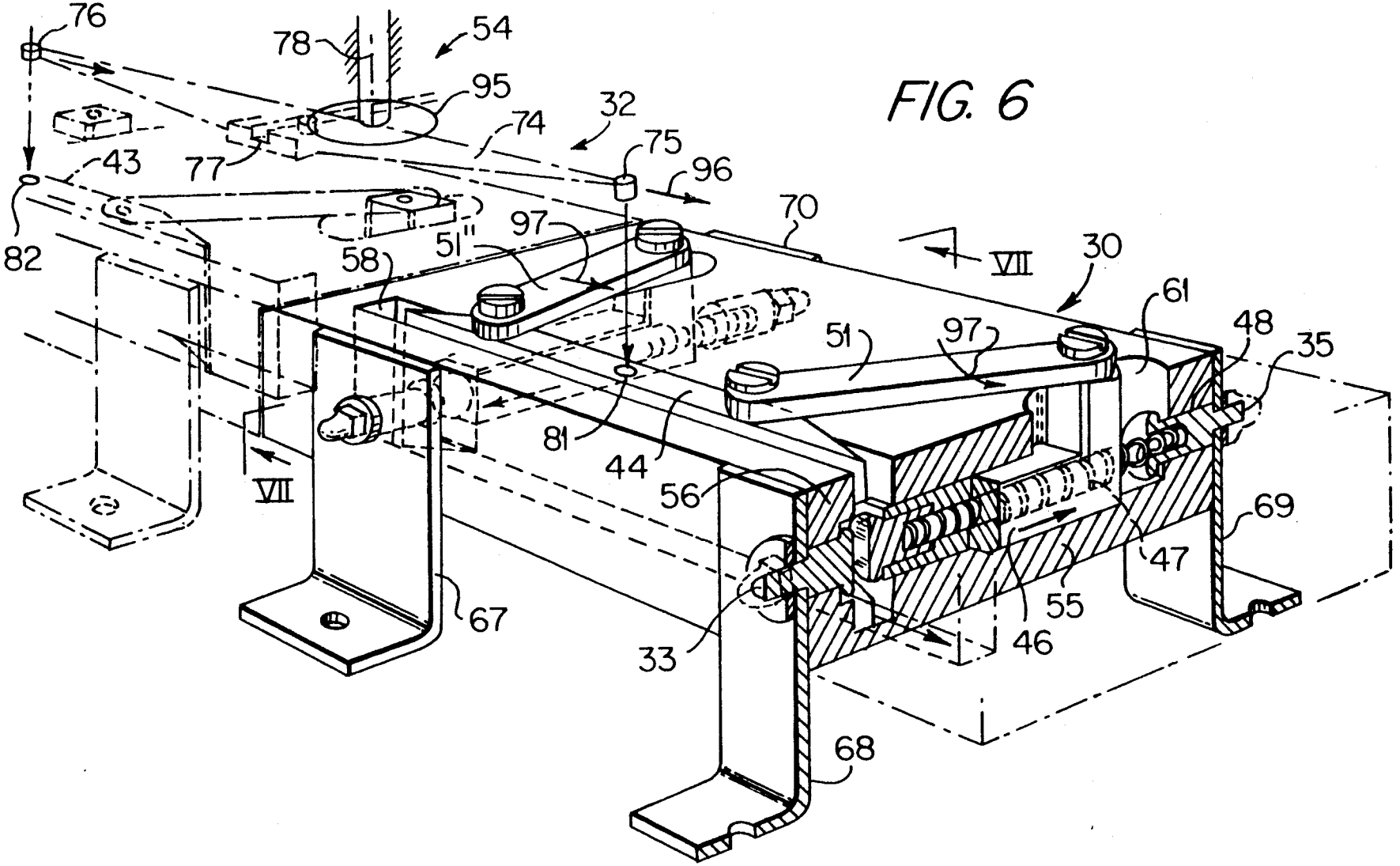
FIG. 6 is a partly sectional view in perspective of a part of a change-over switch according to the present invention.
Figure 7:
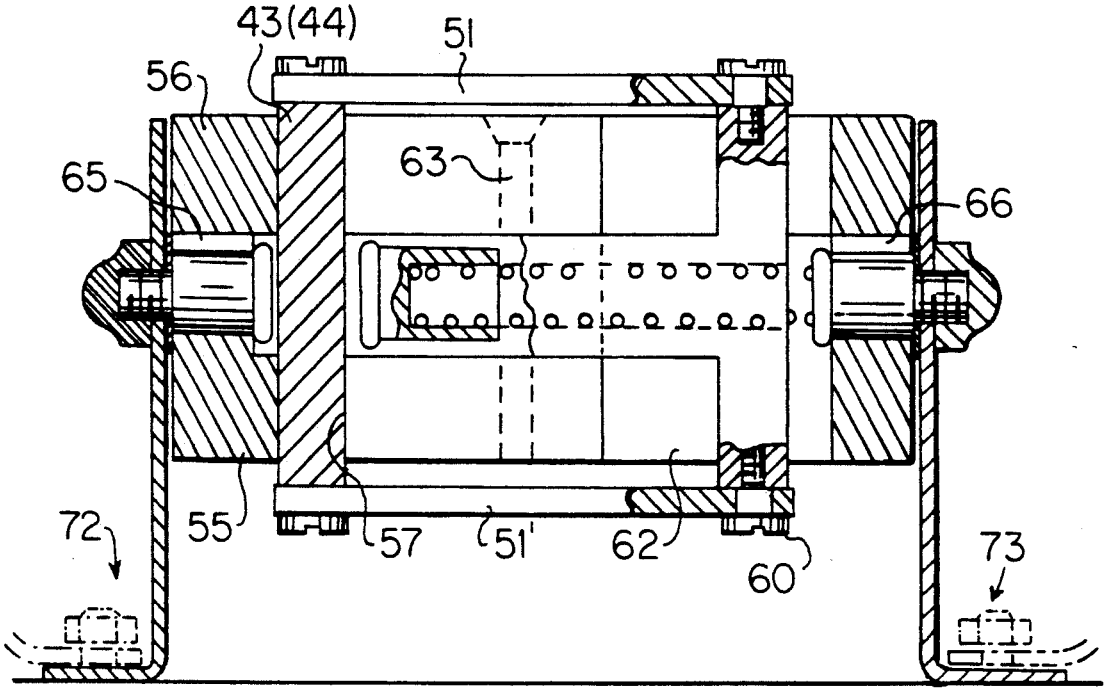
FIG. 7 is a sectional view along the axis VII—VII of FIG. 6.
Figure 8:
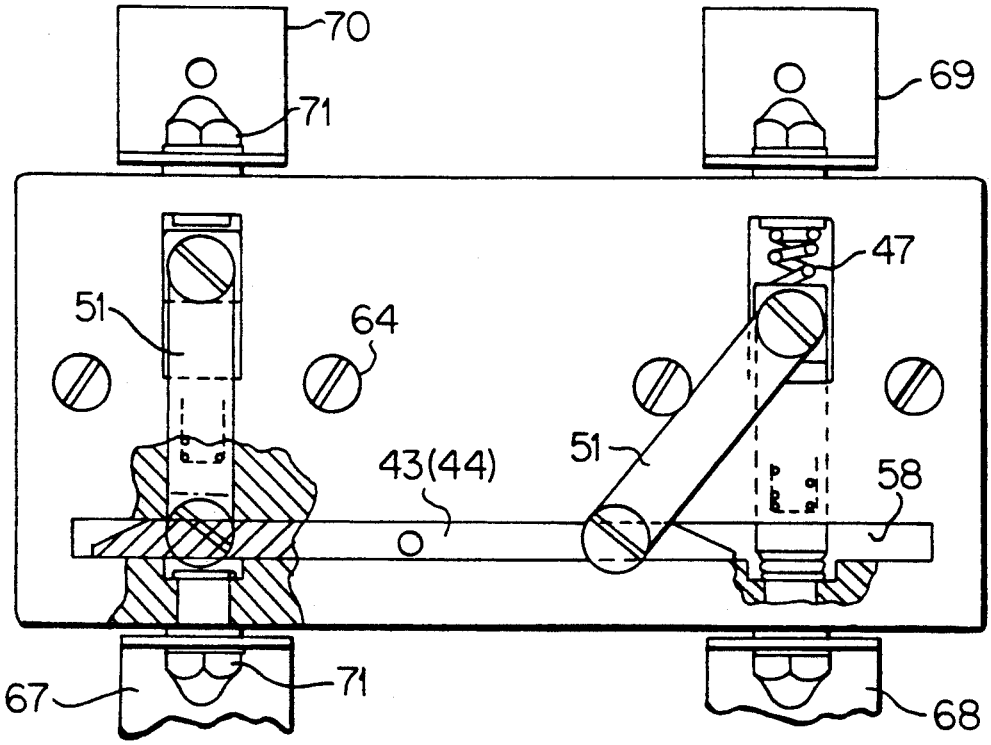
FIG. 8 is a partially cutaway top view of half of a change-over switch as shown in FIG. 6.

FIGS. 6, 7 and 8 give a detailed view of a practical embodiment of a half change-over switch 30 according to the invention. FIG. 6 further showing a part of the second half change-over switch 32 as well as a control device 54 for the set of two half change-over switches. The support of the two contact devices and of the insulation device includes two external plates 55 and 56 that sandwich different internal elements which are shaped to form the bores 49 for the sliding of the contact devices as well as the path 57 for the shifting of the insulation device 43. This shift path 57 extends along the thickness of the plates 55 and 56 by a notch 58 in each plate. The insulation device 43 has the shape of an elongated strip, the edges of which are bevelled on the side having each movable contact element m so as to gradually enter the space between the contact elements during the opening of the electrical contact. A bevelling such as this is aimed at preventing the contacts from touching the insulation device and increasing the path of a possible arcover.

The width of the strip is slightly greater than the thickness of the half-contactor in such a way as to achieve the assembly of the strip with both contact devices by means of four arms, of which three, referenced 51, 51' and 51", may be seen in the Figs., the fourth being the arm symmetrical to the arm 51" in relation to a median plane parallel to the plates 55 and 56. The arms of each pair, 51 and 51' for example, are hinged firstly on the lateral sides of the strip 43 of the insulation device and, secondly, on the hollow finger 46 of the movable contact element m by means of a cross member 59 that is fixedly joined to the finger and has the same width as the insulation strip. The hinges are, for example, formed by screws 60 which are screwed into the strip and the cross member 59 and have a smooth part to enable the rotation of the arms.

To enable the shifting of the cross member 59, the plates 55 and 56 have notches 61 and 62 which have a direction perpendicular to that of the path of shift 57 of the insulation device 43.

This is also the case with the elements that are sandwiched between the two plates 55 and 56 and have not been shown in the Figs.. They may be formed by three insulating rectangular plates, one internal plate between the two contact devices and the other two external plates bordering the two contact devices on the exterior. The external plates 55 and 56 as well as the internal plates are held mutually by bolts and nuts such as those referenced 63, 64.

The fixed contact elements f are borne by a small bar 65 that is inserted between the plates 55 and 56 and is fixed to the two internal plates of the rim. In the same way, the contact elements 48 are borne by a bar 66 that is inserted between the plates 55 and 56 and is fixed to the two internal plates of the rim.

The assembly formed by the plates 55 and 56, the elements sandwiched between said plates, the two contact devices and the insulation device is borne by four lugs 67 to 70 which are, for example, fixed to said assembly by means of threaded heads extending towards the exterior of the fixed contact elements f and the metal elements 48 and nuts 71. These lugs may be metallic and may then be used to make the electrical connections 72 and 73 with, respectively, the high-voltage generator and the X-ray tubes as shall be described here below with reference to FIGS. 9 and 10. These lugs may also be made of an insulating material, the electrical connections being then made directly on the threaded heads of the fixed contact elements f and the metal elements 48.

The device 54 for the control of the two half change-over switches 30 and 32 include, for example, a rigid strip 74 that bears two pins 75 and 76, and a transversal groove 77 and a rotating rod 78 that cooperates with the groove 77 by an off-centered pin 79, this rod ending in a lever 83. The pin 75 gets locked, for example, into a blind hole 81 of the strip of the insulation device 44 while the pin 76 gets locked into a blind hole 82 of the strip of the insulation device 43.

Figure 9:
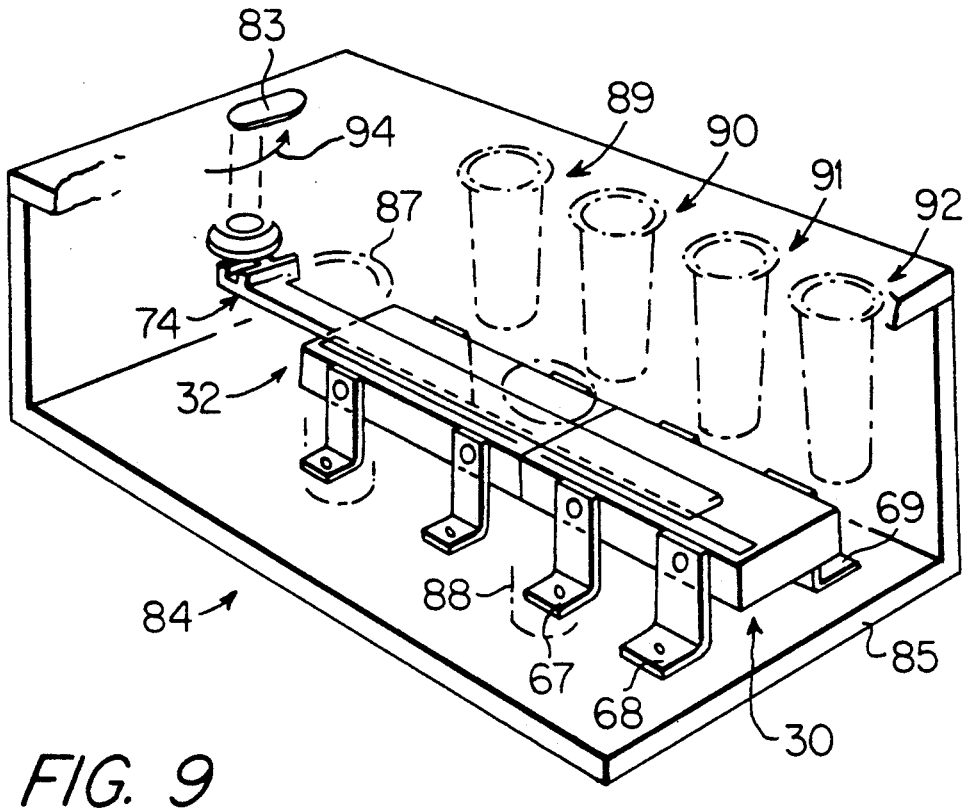
FIG. 9 is an overall and partially cutaway view in perspective of a change-over switch according to the invention.
Figure 10:
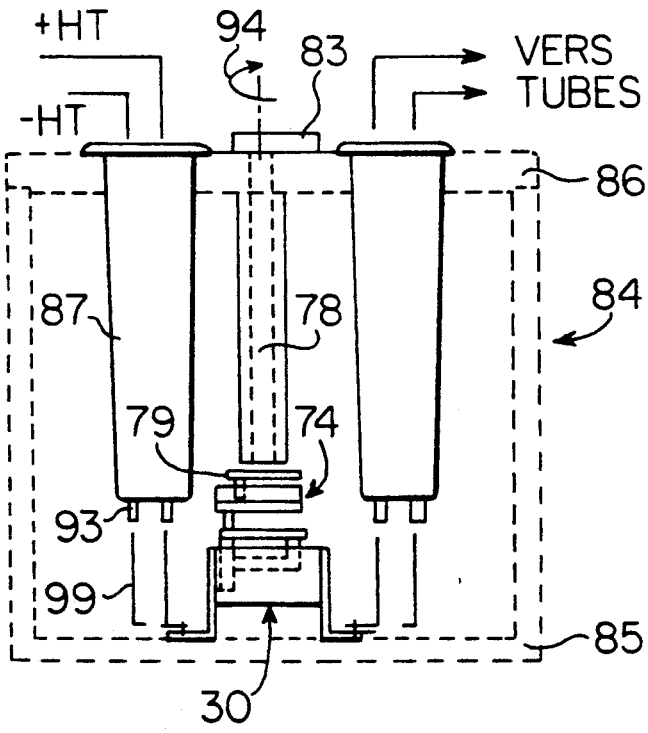
FIG. 10 is a side view of the change-over switch shown in FIG. 9, with the casing removed.

As FIGS. 9 and 10 show, the two half change-over switches 30 and 32 and their control device 54 are placed in a box 84 and fixed, for example, to the bottom 85 by means of the lugs 67 to 70. This box is closed at its upper opening by a lid 86 which acts as a support for the rotating rod 78, the lever 83 being outside the box, and to female parts of connectors, the male parts of which (not shown in FIGS. 9 and 10) are connected to the high-voltage generator 15 and to the X-ray tubes A and B. The female parts of the connectors are referenced 87 and 88 for those connected to the high-voltage generator and 89 to 92 for those connected to the X-ray tubes and have the shape of sleeves which the male parts get fitted into. These sleeves end inside the box 84 by metal contact elements 93 to which there are connected conductors (99) providing links with the fixed contact elements f for the high voltage coming from the high voltage generator and with the metal elements 48 for the high voltage applied to the X-ray tubes.

The box 84 is tightly sealed and contains dry air, but may be filled with an insulating fluid so as to improve the arcover insulation, the direct insulation being obtained by the polymers with high dielectric strength that constitute the different insulating elements of the change-over switch. These insulating element are made of polymer type materials such as polyethylene, polypropylene or other materials. The only metal elements are the lugs such as those referenced 67, the fixed contact elements f and the nuts 71, the movable contact elements m, the springs 47 and the metal elements 48 with the nuts 71.

The change-over switch according to the invention works as follows: the rotation of the lever 83 in the direction of the arrow 94 makes the rod 78 and the pin 79 rotate in the same direction (arrow 95) so that the strip 74 gets shifted towards the right (arrow 96) and the same is the case with the strips of the insulation devices 43 and 44. The arms such as those referenced 51, 51' and 51" rotate in the direction indicated by the arrows 97 in such a way that the movable contact device m to the right of each half change-over switch gradually moves away from the fixed contact element f while the movable contact device m to the left comes gradually into contact with the fixed contact element f. At the same time, the insulating strip of each insulation device gets interposed between the two contact elements that move away from each other but go out of the space of the two contact elements that come into contact. Each strip then provides for the insulation between the two contact elements that move away while at the same time enabling the electrical contact between the two contact elements that approach each other.

The invention has been described with fixed contact elements f connected to the high-voltage generator and movable contacts m connected to the generator, but the change-over switch can be used in reverse, i.e. with the fixed contact elements f connected to the tubes and the movable contact elements m connected to the generator.

As indicated in the description, all the elements, except for those participating in the electrical conduction, are made of an insulating material with high dielectrical strength corresponding to a disruptive voltage of several tens of kilovolts per millimetre. This insulating material is preferably a polymer such as a polyethylene or a polypropylene.

What is claimed is :

1. A high-voltage change-over switch with linear movement for the alternate application of a high voltage either to a first X-ray tube or to a second X-ray tube, said device comprising a change-over switch assembly having two identical half change-over switches, each half change-over switch comprising an insulation device, two input terminals wherein the insulation devices are mechanically linked and two output terminals, and each input terminal being connected to only one respective output terminal by means of a contact device that comprises a fixed contact element and a movable contact element shifting in a linear movement so as to come into contact with said fixed contact element or to move away from it, said linear movement of the two movable contacts of each half change-over switch being obtained by the linear shifting of said insulation device in a direction perpendicular to the movement of the movable contact elements, wherein for each half change-over switch said insulation device works together with the two movable contact elements in such a way that, in a first position of the insulation device, a first contact device is open while the second one is closed and that, in a second position of the insulation device, the first contact device is closed while the second one is open, the contact elements facing each open contact device being separated by a strip made of insulating material that constitutes the insulation device.

2. A change-over switch according to claim 1, wherein each insulation device is constituted by an insulating strip, the longitudinal ends of which are bevelled in such a way as to enter the space between the fixed contact element and the movable contact element without friction

3. A change-over switch according to claim 1, wherein the two insulation devices of the change-over switch are shifted in synchronism by a control device.

4. A change-over switch according to claim 3, wherein the control device comprises a rigid means that is fixed to the two insulation devices, said rigid means being shifted in one direction or in the other depending on the X-ray tube to be supplied.

5. A change-over switch according to claim 1, 2, 3 or 4, wherein the movable contact element of each contact device of each half change-over switch is connected to the insulation device by at least one arm, each of the ends of which pivots about a hinge member, one borne by the movable contact element and the other borne by the insulation device.

6. A change-over switch according to claim 1, 2, 3 or 4, wherein the movable contact element of each contact device of each half change-over switch cooperates with the insulation device by means of a pin fixedly joined to said movable contact element and an element fixedly joined to said insulation device that has a ramp cooperating with said pin.

7. A change-over switch according to any of claims 1 to 4, wherein the movable contact element of each contact device includes a finger that slides in a bore, the end of the finger bearing the metal element for contact with the fixed contact element, while the base of the finger cooperates with a metal element connected to an output terminal by means of a metal spring that provides, firstly, the thrust of the finger towards the fixed contact element and, secondly, the electrical link between the contact element and the metal element.

8. A change-over switch according to claim 7, wherein the finger is made of an insulating material and is hollow in order to act as a housing for said spring which comes into contact, inside the finger, with the contact element.

9. A change-over switch according to any of claims 1 to 4, wherein the two contact devices of each half change-over switch are maintained by two rigid insulating plates that mutually define an internal space filled with an insulating material.

10. A change-over switch according to claim 9, wherein the insulating support plates have notches for the passage and shifting of the insulating device and for the passage and shifting of a cross member for the connection of the movable contact element to the insulation device.

11. A change-over switch according to any of claims 1 to 4, wherein the fixed contact elements are connected to the input terminals of the high voltage while the movable contact elements are connected to the input terminals of the first and second X-ray tubes.

12. A change-over switch according to any of the claims 1 to 4, wherein the movable contact elements are connected to the high-voltage terminals while the fixed contact elements are connected to the input terminals of the first and second X-ray tubes.

13. A change-over switch according to any of claims 1 to 4, wherein the different elements, with the exception of those constituting the contacts, are made of polymer.

14. A change-over switch according to claim 13, wherein the polymer is a polyethylene.

15. A change-over switch according to claim 13 wherein the polymer is a polypropylene.

* * * * *